United States Patent [19]

Workum

[11] Patent Number: 4,773,570

[45] **Date of Patent: * Sep. 27, 1988**

[54] DISCHARGE DEVICE FOR A DEFORMABLE CONTAINER

[75] Inventor: Donald J. Workum, Küsnacht, Switzerland

[73] Assignee: Interscents N.V., Curacao, Netherlands Antilles

[ * ] Notice: The portion of the term of this patent subsequent to Jun. 12, 2004 has been disclaimed.

[21] Appl. No.: 914,493

[22] Filed: Oct. 2, 1986

Related U.S. Application Data

[63] Continuation-in-part of Ser. No. 616,942, Jun. 4, 1984, Pat. No. 4,673,110.

[51] Int. Cl.[4] ..... B65D 25/40; B05B 1/34

[52] U.S. Cl. ..... 222/189; 222/211; 222/213; 222/493; 222/495; 239/493

[58] Field of Search ..... 222/630–632, 222/189, 211–213, 215, 206, 464, 491–493, 495, 525, 546; 239/464, 490, 493

[56] References Cited

U.S. PATENT DOCUMENTS

| | | | |
|---|---|---|---|
| 3,361,304 | 1/1968 | Thompson | 222/189 |
| 3,401,845 | 9/1968 | Bach | 222/213 |
| 3,493,179 | 2/1970 | Lee | 222/211 |
| 4,313,569 | 2/1982 | Burke | 239/493 X |
| 4,673,110 | 6/1987 | Workum | 222/211 |

FOREIGN PATENT DOCUMENTS

| | | | |
|---|---|---|---|
| 197805 | 4/1978 | France | 222/495 |

*Primary Examiner*—Joseph J. Rolla
*Assistant Examiner*—Nils E. Pedersen
*Attorney, Agent, or Firm*—Foley & Lardner, Schwartz, Jeffery, Schwaab, Mack, Blumenthal & Evans

[57] ABSTRACT

The discharge device comprises a member having a plurality of liquid flow openings, an eductor tube, a liquid flow path from the eductor tube to the member with the plurality of liquid flow openings and a valve positioned in the liquid flow path. The valve is movable between a blocking position and a discharge position. The valve is operative in the blocking position to block the liquid flow path and is operative in the discharge position to unblock the liquid flow path. Further, a cap member having a discharge orifice which is larger than any of the plurality of openings is mounted over the member having the plurality of openings. The device produces a fine spray mist. However, the device can also be used to produce a foam by placing a screen over the orifice.

18 Claims, 8 Drawing Sheets

DISCHARGE DEVICE FOR A DEFORMABLE CONTAINER

RELATED APPLICATIONS

The present application is a continuation-in-part of U.S. patent application Ser. No. 616,942, filed June 4, 1984, now U.S. Pat. No. 4,673,110.

BACKGROUND OF THE INVENTION

Field of the Invention

The present invention relates to a spray discharge device and to a foamer device for a deformable container of the type employed in a number of industries including household cleaning products and toilet products. By means of this device, expendable liquids are dispersed in a fine spray or in a foam from a container made of material which is sufficiently flexible to be deformable by hand. Containers of this type can thus be compressed by the user in order to produce a pressure for the purpose of discharging their liquid contents through an eductor tube which extends to the bottom of the container and in order to be subsequently reinflated under elastic action while producing a partial vacuum which has the effect of sucking-in air from the exterior of the container.

The invention relates more specifically to devices of this type which comprise a single orifice extending through a rigid cover which closes the container. The orifice serves both to expel liquid to be sprayed or foamed and to suck-in air from the exterior.

SUMMARY OF THE INVENTION

The essential aim of the invention is to improve the operation of the spray-discharge device and foam discharge device in their different stages while at the same time permitting manufacture at low cost. Compared with known devices ofthe prior art, the spray-dispensing device and foam dispensing device in accordance with the invention in fact have the main advantages of ensuring a high quality of atomization dispersion or foam production, of preventing any disturbances arising form changes in level of liquid as the container is being emptied during use, of ensuring a rapid entry of external air from the outside into the container after a spraying or foaming operation, and generally of increasing the possibility and efficiency of repeated spraying or foaming operations within very short periods of time.

To this end, the device in accordance with the invention essentially comprises a valve unit which is capable of moving axially within the container between a discharge position and an air-suction position with respect to a rigid cover which closes the container and is provided with the orifice for discharge of liquid and suction of air. The valve unit is adapted to support a member for shutting-off the eductor tube in its air suction position and defines air and liquid flow channels which lead to the orifice. If a spray discharge is desired, the orifice is left open. If a foam discharge is desired, a screen mesh is attached over the orifice.

In one embodiment, the eductor tube closure member is formed in one piece with the valve cap and is constituted by an axial stem which may be tubular and penetrates into a cup forming a connection between the eductor tube and the valve until it comes into leak-tight contact with the cup in the air-suction position.

In another embodiment, the valve unit is constructed in the form of two components fitted one within the other for displacement in relative sliding motion between two end positions. One component is adapted to carry the valve cap which defines a nozzle in the discharge position. The other component is adapted to carry the eductor tube closure member. This design concept makes it possible to obtain a prompt moving effect on the closure member when leaving the closing position to the discharge position.

It is an advantage to provide the valve unit both at the top end corresponding to the container cover and at the bottom end corresponding to the eductor tube with large surfaces which can be subjected in alternate sequence either to the pressure required for upward displacement of the valve unit in the discharge position or to the effects of the partial vacuum produced within the container when it is no longer compressed. This is the most significant function performed by the valve cap in producing a rapid movement of the valve unit when the valve cap is located between the orifice of the container cover and the opening which establishes a communication between the device and the interior of the container. Guiding of the valve unit with respect to the fixed component of the device, in particular with respect to the cover which closes the container, is preferably arranged in such a manner as to ensure that air is readily and freely admitted into the container during the suction stage.

It will be noted that the orifice formed through the container cover can be as large as requirements may dictate in order to permit easy penetration of air sucked-in from the exterior. This does not interfere with operation in the discharge condition since in this case the crosssectional area for flow of liquid is determined by the opposite faces of the valve unit and of the container cover in the vicinity of the same orifice. Preferably, the faces may be flat at this point and the ducts, arranged in a radiating pattern with respect to the orifice of the container cover, may be provided in either or both of the faces. If so required, the ducts may open tangentially into the orifice in order to form a vortical-flow nozzle.

In a preferred design the valve unit may have a cylindrical body with a conical upper surface containing a ring of openings leading from the liquid flow channel. Ribs may extend upwardly between the openings to space the valve unit from the inner face of the container cover. The ribs form flow channels between adjacent ribs and may be slanted at an angle to a radius of the body to impart a swirling motion to the mixture as it passes through the channels.

Alternatively, the ribs may be fixed to the cover inner face and the conical surface of the valve unit may be smooth, except for the opening.

BRIEF DESCRIPTION OF THE DRAWINGS

Other features of the invention will be more apparent to those skilled in the art upon consideration of the following description and accompanying drawings, wherein.

DETAILED DESCRIPTION OF THE PREFERRED EMBODIMENTS

Figure 1:
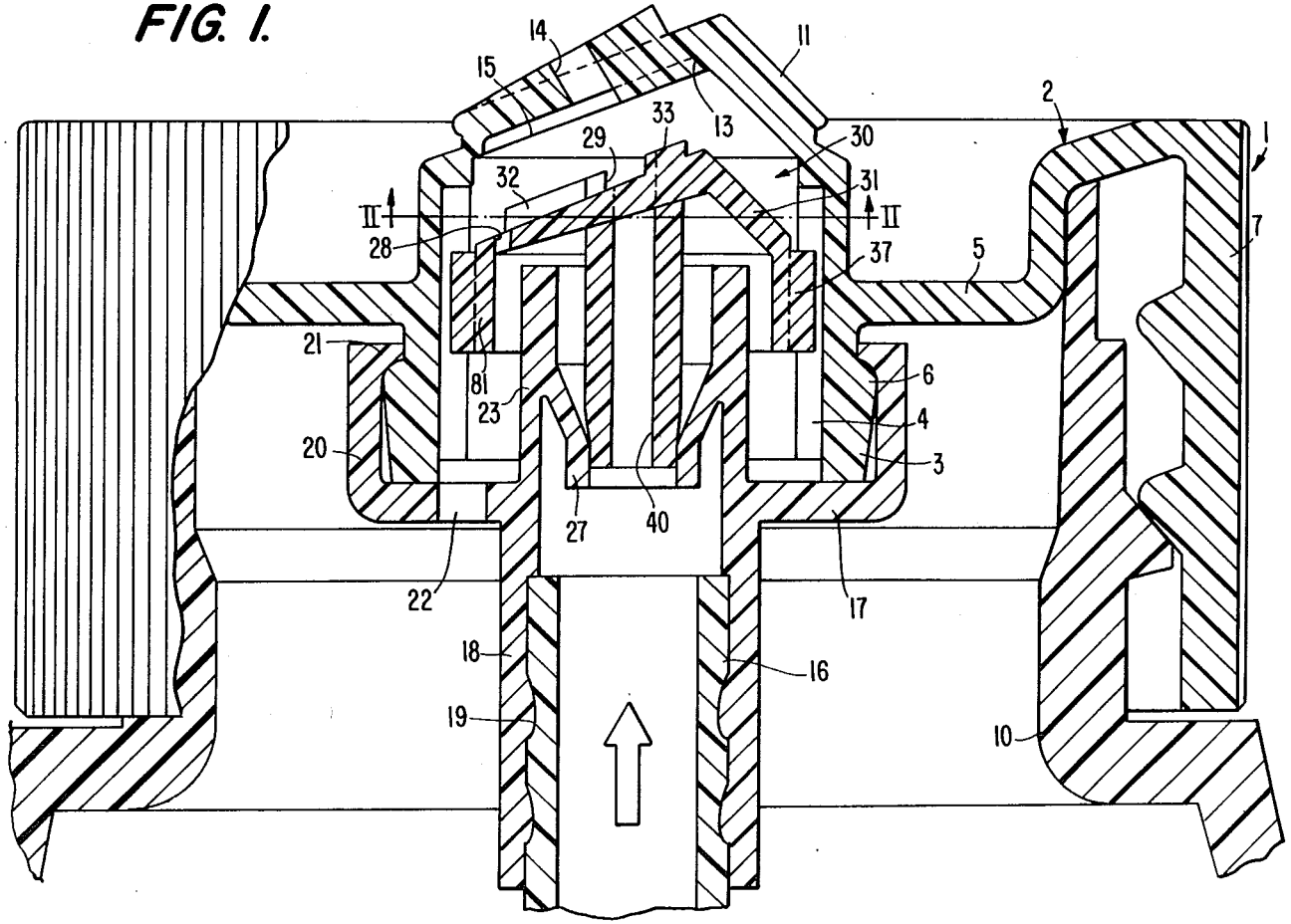
FIG. 1. is an axial sectional view in elevation showing a first embodiment of a discharge device in accordance with the invention.

The discharge device of FIG. 1 as generally designated by the reference numeral 1 essentially comprises a valve unit 30 which is displaceably mounted within a valve body comprising a cover 2 which serves to close the container 10. The cover 2 is provided internally with a cylindrical skirt 3. Axial grooves 4 which, in the embodiment shown, are two in number and located in diametrically opposite relation are cut in the internal wall of said skirt 3. The container cover is provided with an annular bulge 6 formed on the external wall of the skirt 3 within the interior of the container. The surfaces of the annular bulge have an inclination such as to permit the coupling function to which further reference will be made hereinafter. An annular trough 5 joins the inner skirt 3 to an outer skirt 7 which serves to fix the cover by screwing or snap-action engagement on the neck of the container 10, only a top fragment of which is shown in the figure.

Figure 7:
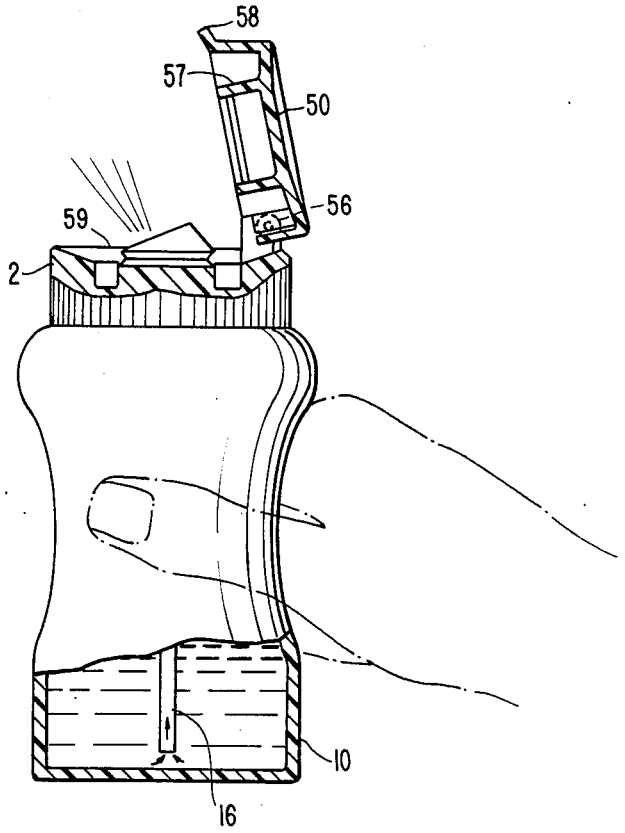
FIG. 7 is a general view of a container equipped with the discharge device in accordance with the invention and shows in cross-section a hinged cap for protecting the device.

However, the container 10 is illustrated in FIG. 7 and it is apparent from this figure that the container is formed of flexible plastic material which makes it deformable by the user's hand and readily reverts to its initial shape after elastic stress. In accordance with customary practice, compression of the container by the user initiates discharge operation whereas a return to the normal position has the effect of drawing external air into the container.

Figure 2:
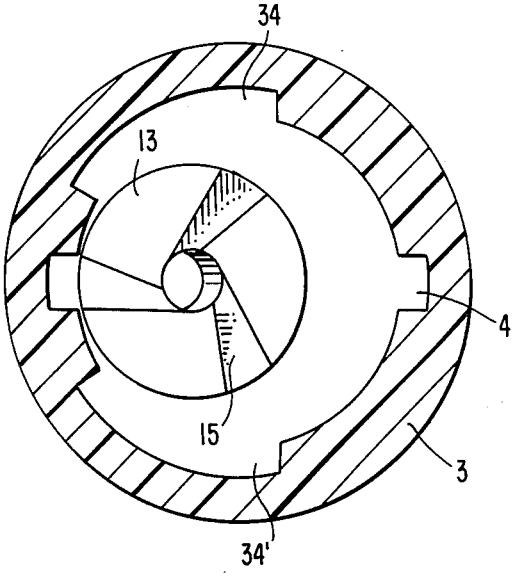
FIG. 2 is a bottom sectional view taken along the line II—II of FIG. 1 and relates to the same embodiment but shows the central portion of the cover which serves to close the device.

The upper portion 11 of the container cover 2 which closes the central portion above the internal cylindrical skirt 3 is constituted by a wall whose internal face forms at least one flat bearing surface 13. As shown in FIGS. 1 and 2, the flat bearing surface 13 is arranged obliquely with respect to the axis of the container cover 2 and is of circular shape. An orifice 14 is pierced through the wall of the container cover at the center of the flat portion 13 in an orientation which is also oblique. In the embodiment shown, the bearing surface 13 is provided with grooves which form ducts 15 in a radiating arrangement and open tangentially into the orifice 14. Preferably, the grooves are uniformly spaced and are three in number. This design concept corresponds to that of a so-called vortex nozzle.

Through the bottom portion of the skirt 3, the container cover 2 communicates with the eductor tube 16, the lower end of which has its opening near the bottom of the container 10. Preferably, this communication between the eductor tube 16 and the container cover 2 is established by a connecting member consisting of a cup 17, a lower tubular extension 18, which is provided with annular channels, and beads 19 which are capable of engaging the external surface of the eductor tube so as to ensure an air-tight assembly. However, it is also possible to employ any other mode of connection such as snap-action engagement or the like.

The cup 17 forms an annular recess surrounded by an outer skirt 20 and by an inner skirt 23, this inner skirt being located in the line of extension of the lower tubular portion 18. The outer skirt 20 is provided at its upper end with an internal projection 21 which ensures a practically leak-tight coupling with the annular bulge 6 of the cylindrical skirt 3 of the container cover 2. The bottom of the cup 17 is pierced by one or a number of orifices 22 which are usually three in number and allow air to flow in each direction between the air-filled headspace located above the liquid in the container and the internal portion of the discharge valve, namely the portion delimited by the cup 17 and the central top portion of the container cover 2. The internal portion also communicates with the eductor tube 16 through the interior of the cylindrical skirt 23 at the level of a valve seat formed by an internal lip 27 of the skirt. The valve unit 30 is adapted to cooperate with the valve seat in order to cut-off communication between the interior of the spray-discharge valve body and the eductor tube when the valve unit is in the position corresponding to the air suction stage after a discharge operation.

The valve unit 30 is capable of displacement with the discharge valve body between two end-positions: the bottom position corresponds to the air intake stage and the top position corresponds to the discharge stage. The valve unit has an axial stem 40 above which is mounted a valve cap 31. The axial stem 40 is hollow in the particular case which is illustrated. The stem constitutes the eductor tube closure member and has a frusto-conical end section which is adapted to its functions of accurate leak-tight contact with the lip 27. The valve cap 31 forms an internal annular cavity which has a bottom opening and into which penetrates the skirt 23 of the cup 17 but without any contact between their respective walls. This arrangement permits efficient guiding of the liquid which is discharged from the eductor tube when the valve unit is displaced in the upward direction for a discharge operation. Orifices 28 are provided inside an annular part 81 of the cap surrounding skirt 23.

Figure 3:
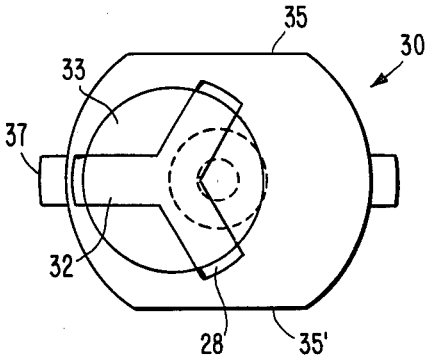
FIG. 3 is a top view of the valve unit which is assumed to be separate from the other components of the device.

The discharge position is not shown in FIG. 1. However, the complementary shapes of the outer (upper) face of the valve cap 31 and the inner (lower) face of the central portion 11 of the container cover are clearly apparent in this figure and will now be described, not only with reference to this figure but also with reference to the complementary FIGS. 2 and 3.

The outer face of the valve cap is provided with a flat bearing surface 33 having a circular contour which, in the discharge position, is applied against the flat bearing surface 13 of the container cover which has already been described. In the case of an oblique spray jet, these bearing surfaces are also oblique and displaced off-center with respect to the axis of the device. It has already been mentioned that grooves 15 are cut in the bearing surface 13 in a radiating pattern which is tangential with respect to the orifice 14, thus permitting operation of a vortical-flow nozzle in the discharge stage. In a comparable manner, grooves 32 are cut in the bearing surface 33 of the valve unit. Provision is made for three grooves corresponding to the grooves 15. Bearing surfaces 13 and 33 have corresponding shapes to come in tight contact. The grooves 32 open into a common recess 29 which is placed opposite to the spray-discharge orifice 14. At their radially opposite ends, the grooves have their openings at the level of orifices 28 pierced through the wall of the valve cap inside annular part 81. These orifices allow air to flow between the top face and the underneath face of cap 31, but their primary function is to permit the flow of liquid in the discharge stage. When the valve unit has reached the top end-of-travel position in which it is applied against the internal face of the cover, the respective grooves 15 and 32 cooperate so as to form ducts which are the only passageways for the flow of liquid propelled through orifices 28 and conveyed through these ducts to the discharge orifice 14. The vortical flow nozzle is thus formed.

By virtue of this arrangement, the cross-sectional area for the discharge being formed is defined by the ducts, and not by the section of orifice 14. The liquid is mixed with air issuing from the interior of the container via orifices 22, which produces a venturi-tube effect. The air and liquid rates in the discharge are determined independently. The liquid part depends on the size of orifices 28 and on how much the eductor tube valve opens. The air stream depends on the size of the orifices 22, inasmuch as the valve unit is dimensioned so that no restriction to the air flow occurs around it. The air stream which is mixed with the liquid as it enters the ducts of the nozzle makes it break into fine drops, thus forming a spray inside the ducts.

Regarding the discharge orifice, it is to be noted that this orifice is freely determined so as to permit the most efficient admission of air when the container is restored to its initial shape as a result of elasticity after a discharge operation. It will further be noted that the valve cap 31 represents a large surface area which is responsive to the effects both of the discharge pressure and of the suction pressure.

It is important to give due consideration to the fact that the particular design concept of the nozzle formed by the cooperating faces of the valve unit and of the container cover in the vicinity of the orifice 14 makes this nozzle radically different from a simple restriction of the cross-sectional area of the rifice 14 by means of a conepoint. However, the special shape which has been described is not intended to imply any limitation. In particular, the duct conveying the liquid/air mixture could be formed only on the valve cap or else only on the internal face of the container cover.

In the case of an oblique-jet nozzle as described in the foregoing, the valve unit 30 is secured against rotation in its longitudinal displacements with respect to the container cover 2. To this end, the valve cap 31 is provided externally with two wings 37 located in diametrically opposite positions and slidably mounted in the longitudinal grooves 4 of the internal skirt of the container cover. It is apparent from FIG. 2 that, in addition to grooves 4, the skirt 3 of the container cover forms wide recesses 34 and 34' which leave free spaces at these locations between the valve unit and the container cover whereas the cross-section of part 81 is provided with flat portions 35 and 35' which increase the space even further. This design facilitates the circulation for the air stream which passes through the orifices 14 and 22, mainly by flowing around the valve unit and additionally through the orifices 28 in the suction phase.

Figure 4:
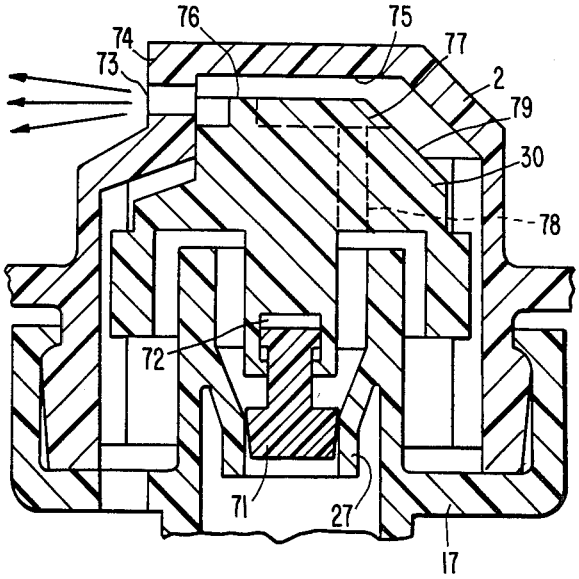
FIG. 4 is an axial sectional view of the central portion of the device in an embodiment which constitutes a variant of the device shown in FIG. 1 and is intended to produce a horizontal discharge.

In the embodiment of FIG. 4, there are again shown the essential elements which have already been described and which essentially consist of the container cover 2, only the central portion of which is illustrated, the cup 17, only the top portion of which is visible in the figure, and the valve unit 30. In this case, the valve unit 30 is constructed in two parts and comprises a valve 71, the lower portion of which constitutes the eductor tube closure member which cooperates with the lip 27 of the valve unit. The upper portion of the piston is contained within a cavity 72 of the other part of the valve unit. The connection provided at this level permits displacement in longitudinal sliding motion between two end-of-travel positions which are such as to ensure that, in the first place, the closure member is not liable to be hindered as it comes into contact with the lip 27 and that, in the second place, there is no potential danger of interference between the cooperating faces forming the discharge nozzle as they are applied against each other. The displacements of the valve 71 with respect to the other portion of the valve unit 30 improve the operation of the device due to a sudden driving effect on the valve unit at the instant the latter leaves the position where it closes the eductor tube.

The design of the upper portion of the valve unit which forms the valve cap in particular is distinguished from the arrangement of FIG. 1 in the fact that the container cover, the valve unit and the nozzle are so designed as to form a discharge which is horizontal or in other words perpendicular to the axis of the device. It is thus apparent that the discharge orifice 73 is pierced through a vertical wall 74 of the container cover. The valve unit has a flat vertical face which slides against the vertical wall. The flat bearing surfaces of the container cover and the valve unit which are applied against each other in the discharge position are shown respectively at 75 and 76. The nozzle passages or ducts are formed by grooves 77 solely in the valve unit. Only two such grooves are provided and extend together opposite to the discharge orifice 73. The opposite ends of the grooves terminate at the ends of two ducts 78 which communicate with the space formed beneath the valve cap.

Figure 5:
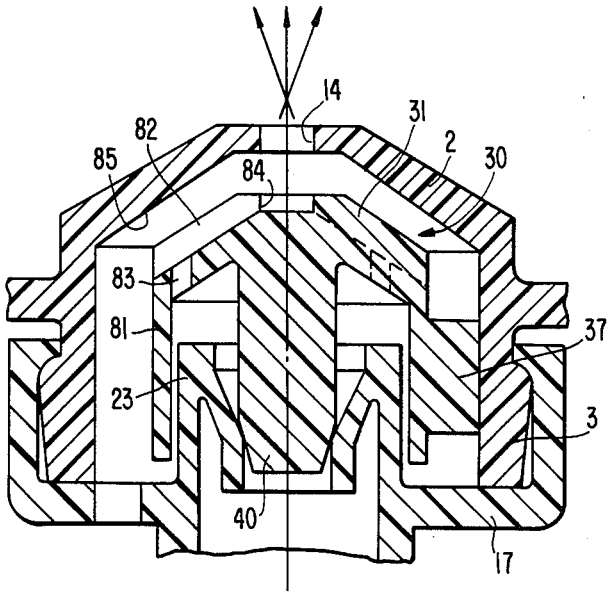
FIG. 5 is a similar sectional view in another alternative embodiment which is intended to produce a vertical discharge.

The embodiment of FIG. 5 is also very similar to the embodiment of FIG. 1 but is adapted in this case to produce a vertical jet in the axis of the container and of the discharge device. There are therefore again shown in this figure the container cover 2, the cup 17 and the valve unit 30 with its cap 31 having a downward extension in the form of a longitudinal annular portion 81 which carries the guide wings 37. But all these components are endowed with symmetry of revolution since the discharge orifice 14 of the container cover located in the axis of the container. In the particular case which is illustrated, the nozzle comprises three ducts formed against the underface 85 of the container cover 2, which is smooth, by means of three grooves 82 cut in the top face of the valve cap 31 so as to convey the discharge admitted through peripheral orifices 83 up to the axial recess 84 in a vortical flow pattern. In consequence, it has not been considered useful to provide guide grooves within the cylindrical skirt 3 of the container cover since the wings 37 have a centering effect without any special orientation.

Moreover, it has been assumed that the valve stem 40 is solid and that a relatively small clearance is allowed between the central duct 23 of the cup 17 and the annular portion 81 of the valve cap which surrounds the duct. Thus the separation provided between the air and liquid circuits is even more complete than in the alternative embodiments described earlier.

Figure 6:
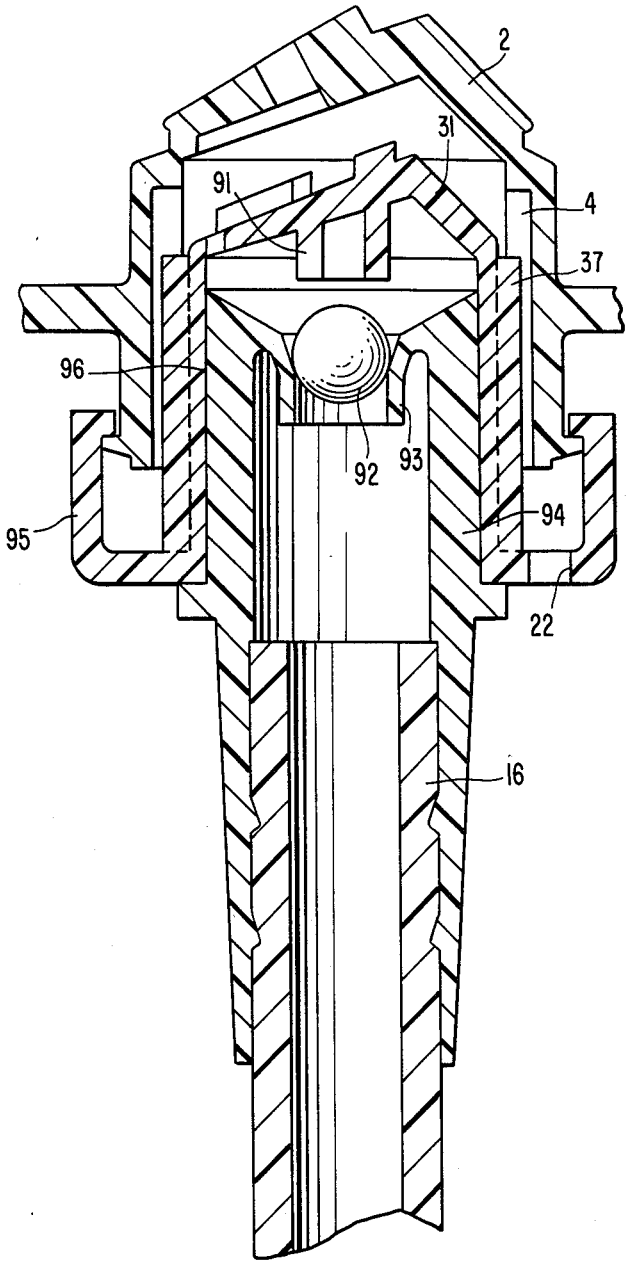
FIG. 6 is yet another view in a similar cross-section and showing a fourth embodiment.

The difference between the embodiment of FIG. 6 and the embodiments described thus far lies in the fact that the two functions of the valve unit are assigned to two separate and distinct elements. The design of the discharge nozzle portion is strictly in accordance with the embodiment of FIG. 1. The same applies to the design of the valve cap 31 together with its guide wings 37 which are slidably engaged in grooves 4 of the container cover 2. On the other hand, the axial stem 91 which is rigidly fixed to the valve cap 31 does not directly perform the function of a closure member for preventing communication with the eductor tube 16. This function is performed by a valve ball 92.

The ball 92 is capable of displacement between a top position in which it is thrust upward under the pressure of liquid and retained by the stem 91 and a bottom position in which it is applied against a valve seat as a result of the partial vacuum produced after a discharge. The valve seat is formed by lip 93 located within a tube 94 which is mounted on the upper end of the eductor tube.

Another difference which is apparent from this figure lies in the fact that the cup of the previous figures is replaced by the housing 94 and a cup-shaped annular member 95 which is formed in one piece with the cylindrical extension 96 of the valve cap 31. The cup-shaped annular member which is provided with the air-intake orifices 22 is therefore intended to move with the valve unit and the same applies to the housing 94 which is fixed within said valve unit and replaces the central duct of the cup shown in FIG. 1. At the same time, the liquid expulsion and air suction circuits are completely separate on each side of the cylindrical extension 96 although they are combined within the upper portion of the device above the valve cap 31.

Among other points noted in the foregoing description, it will have become apparent that the valve unit of the device in accordance with the invention always combines the function of opening and closing the inlets for admission of liquid with the function which consists alternately in forming the discharge nozzle and in releasing the air-admission inlet. Furthermore, it can be understood from the description of specific embodiments, that the shape of the valve cap, when curved and hollow underneath, is efficient to lead liquid to the nozzle, while the circuit for the return of external air after each discharge operation is separate since it is located essentially outside the valve unit. Referring specifically to the embodiment of FIG. 4, it will be noted that the rear face 79 and the lateral faces are cut away from the cover, to permit the flow of air in the suction stage.

Figure 8:
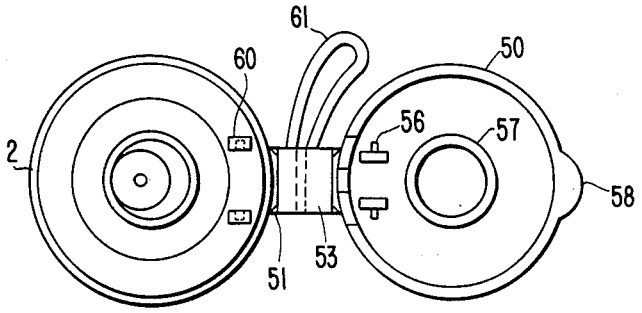
FIG. 8. is a top view of the device fitted with the protective cap in which the cap is in the fully open position.

In an industrial embodiment which will now be described with reference to FIGS. 7 and 8, the discharge device in accordance with the invention is provided with a protective cap 50 forming a tamper-proof sealing capsule. This protective cap closes against the container cover 2, entirely covers the cover and is capable of pivotal displacement about a hinge axis formed by two pivots 56 carried by projecting lugs provided on the underface of the protective cap 50. The pivots are housed within cavities 60 formed in corresponding lugs provided on the top face of the container cover 2.

In a position diametrically opposite to the hinge axis, the protective cap 50 has a small tongue 58 which serves to lift the cap with a finger. The protective cap also has a cylindrical skirt 57, the lower edge of which is adapted to engage by snap-fastening on an annular bead 59 formed on the central portion of the container cover 2.

In addition, the container cover 2 and the protective cap 50 are initially joined together at their edges in proximity to the hinge axis by means of strips 51 which can readily be fractured at the four corners of a flexible plate 53 which is thus folded in two at the center until the dispenser is used for the first time. The low strength of the strips 51 makes it possible to tear-off the plate 53 when the user lifts the protective cap 50 for the first time by exerting a light force on each side of the hinge. It is also possible to remove the plate 53 beforehand by pulling on a loop 61 specially provided for this purpose.

In the embodiments of the invention shown in FIGS. 1–8, the orifice in the cap is shown as being open. In this case, the discharge is a spray having a fine mist. The size of the mist droplets is a function of the size of the openings for the liquid and the air. For example, in FIG. 1, the size of the liquid openings 28 relative to the size of the air openings 22 determines the size of the droplets in the mist. It has also been discovered that by placing a screen over the discharge orifice, the discharge will be a foam in the case of any liquid having a sufficiently high surface tension. The screen can be placed at virtually any distance from the discharge opening and the screen size can vary depending on the liquid being used and the density of the foam desired.

Figure 9:
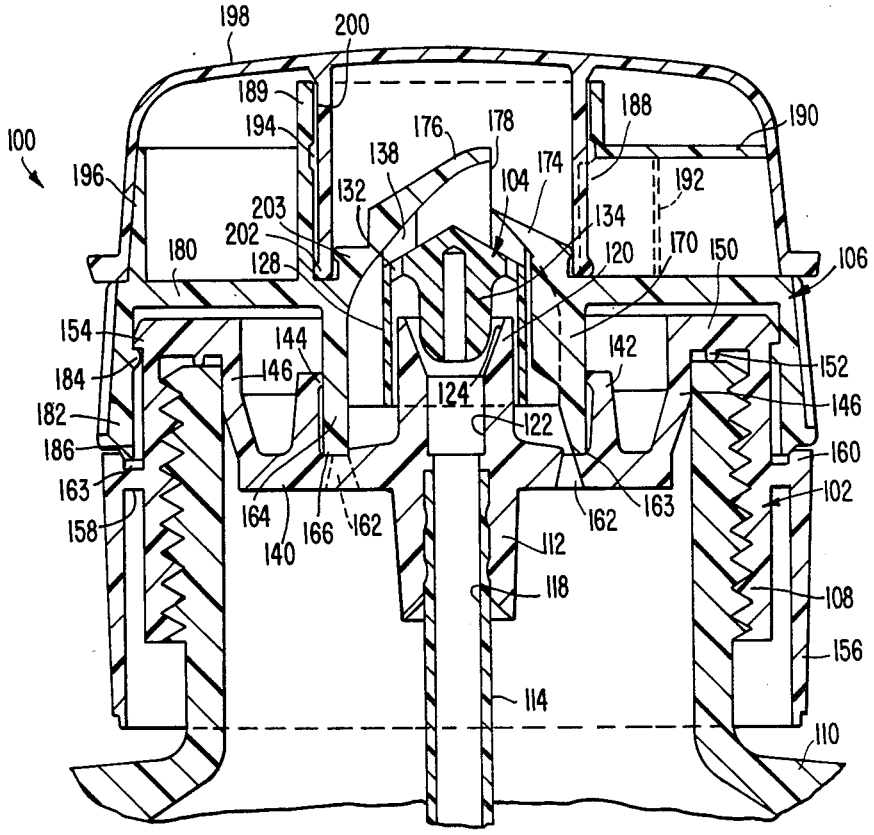
FIG. 9 is an axial sectional view in elevation showing a further embodiment of the present invention.

FIG. 9 shows a further embodiment for the present invention which has certain advantages over the previously described embodiments. The embodiment shown in FIG. 9 is constructed for use as a foamer, but the valve construction is also suitable for use in producing a spray discharge. The discharge device 100 of FIG. 9 comprises a lower cap portion 102 which mounts a valve unit 104. An upper cap portion 106 is mounted on the lower cap portion and is movable relative to the lower cap portion, as will be discussed below.

The lower cap portion 102 contains a threaded portion 108 by which it is mounted on a squeeze bottle 110 which has mating threads. The lower cap portion 102 has a generally cylindrical eductor mounting portion 112 which mounts the eductor tube 114. A passageway 118 is formed inside of the eductor mounting portion 112 and forms part of the liquid flow path. A generally cylindrical valve unit mounting portion 120 is in alignment with the eductor mounting portion 112 and contains a passageway 122 which aligns with the passageway 118 to form a continuation of the liquid flow channel. Passageway 122 opens at its top to form a frustoconical valve seat 124.

Figure 10:
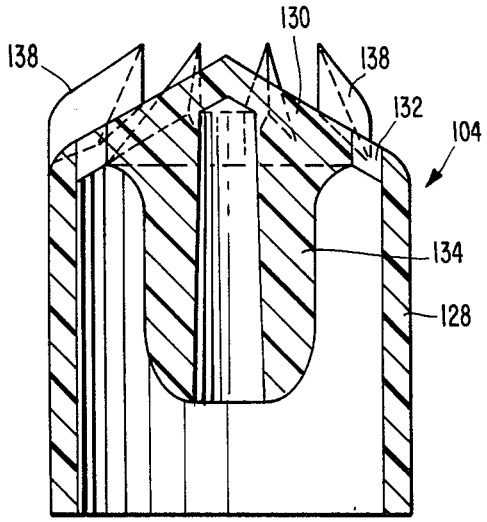
FIG. 10 is an elevational sectional view of the valve unit of the embodiment of FIG. 9.
Figure 11:
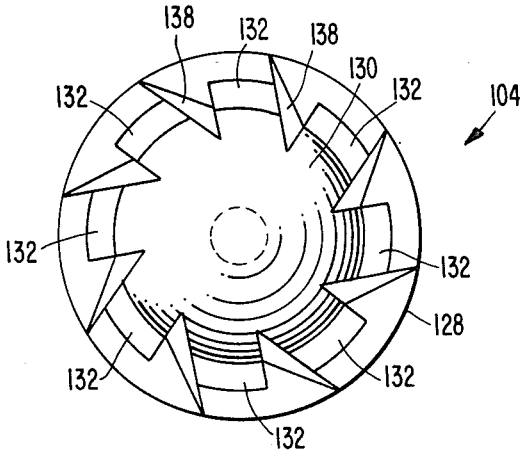
FIG. 11 is a top plan view of the valve unit of FIG. 10.

The valve unit 104 is shown in FIGS. 9–11 to comprise a cylindrical body 128 with a generally conical top 130. A plurality of openings 132 pass through the cylindrical top 130 to communicate the interior of the valve unit with the exterior through the top. A valve stem 134 depends from the cylindrical top 130 such that the outer surface of the valve stem is spaced from the inner surface of the body 128. The valve stem is shown to be hollow in order to reduce the weight of the valve unit. A plurality of ribs 138 extend upwardly from the upper surface of the conical top 130. The ribs 138 are positioned between the openings 132 to form channels which pass over the openings. As can be seen most clearly in FIG. 11, each rib 138 is angled relative to a radius of the body 128 so as to extend from one opening 132 to the adjacent opening 132 to form a channel which converges on a single opening. In this manner, any flow which impacts a rib 138 will be directed in the circumferential direction and then will be forced to pass over an opening 132. It will also be noted that the top of each rib 138 is formed at an upwardly inclined angle, for a purpose which will be discussed below.

Returning to FIG. 9, it will be seen that the valve unit 104 is received on the lower cap portion 102 such that the body 128 extends around the valve mounting portion 120 and the valve stem 134 is received in the frustoconical opening formed by the valve seat 124. The valve member can rotate freely and can move up and down to open or close the liquid flow channel by either being lifted off the valve seat 124 by fluid pressure from fluid in the container or sealing against the valve seat 124. This operation is similar to that described above with respect to the previously described embodiments except that the embodiment of FIG. 9 does not include any structure to stop the valve unit from rotating, as in FIG. 5.

Also with reference to FIG. 9, it can be seen that the lower cap portion 102 has a disc-shaped flange 140 which extends outwardly from the portions 112 and 120. A ring shaped sealing flange 142 extends upwardly from the flange 140 and contains an enlarged end 144. Another ring-shaped flange 146 extends upwardly from the end of the disc-shaped flange 140. A horizontal member 150 of the lower cap portion 102 extends from the flange 146 across the top of the container 110 and is attached to the threaded portion 108. The horizontal member 150 has a sealing lip 152 which is drawn down onto the top of the upper rim of the container 110 to form a liquid tight seal when the lower cap portion 102 is screwed onto the container 110.

A ridge 154 extends out from the horizontal portion 150 to form a latch surface. Also, a ring 156 is attached to the threaded portion 108 through a web 158. The ring may be knurled or the like to enable a user to easily grasp the lower cap portion 102. The ring 156 includes an upward extension 160 which forms a groove which receives a part of the upper cap portion, as will be discussed below.

Finally, the lower cap portion 102 has a plurality of holes 162 formed in the disc-shaped flange 140. The holes 162 are spaced inwardly of the flange 142 and open into a small channel 163 to communicate the interior of the container 110 with the space within the flange 142.

The upper cap portion 106 has an inner body 164 which has an outer generally cylindrical surface that abuts the enlarged end 144 of the flange 142 to form a liquid tight seal. The body 164 has a lower edge 166 which rides in the small channel 163. The edge has a width which progressively increases and decreases around the circumference of the body 164. At its widest point, the edge can cover the entire opening of one of the holes 162 and at its smallest, the edge 166 fits between an opening of a hole 166 and the flange 142. The holes 162 and the edge 166 are related so that the body 164 can be rotated to cause the edge 166 to progressively close or to progressively open the holes 162 to adjust the ratio of liquid to air discharged by the discharge device 100 The body 164 can be rotated to a position where edge 166 completely closes holes 162 in order to produce a completely liquid discharge. Furthermore, during normal operation, with the device 100 upright, the air flow rate will be greater than the liquid flow rate. With the device inverted, air will flow through eductor tube 114 and liquid will flow through opening 162. By properly adjusting the size of openings 162, the proper ratio of air to liquid can be maintained, and the device can be operated upside down, although the operation efficiency will not be as great since there will be no venturi effect.

At the inside of the body 164, there are a plurality of inwardly extending ribs 170 which serve to space the valve unit 104 from the body 164. The ribs 170 have inner edges which are parallel to the outer surface of the valve unit 104 to hold the valve unit in an upright position when the valve unit 104 is moving.

At the top of the body 164, there is an inwardly and upwardly directed wall 174 which has an inner surface at an angle which matches the angle of the top surface of ribs 138 so that the ribs ride against the wall 174 when the valve unit 104 is forced upwardly. The ribs 138 space the conical upper surface of the valve unit 104 from the wall 174 so that air from the holes 162 can travel over the top of the valve unit.

The height of the wall 174 increases abruptly at 176 to form a discharge opening 178. Discharge opening 178 directs a spray discharge horizontally.

Extending outwardly from the body 164 is a substantially planar member 180 which attaches to a depending ring-shaped member 182. Member 182 has an inner surface with a bulge 184 that fits under the latch 154. Also, at the bottom of the ring-shaped member 182 there is a depending lip 186 which fits into the groove 163. Accordingly, the upper cap portion is attached to the lower cap portion but is able to rotate relative to the lower cap portion. In this manner, the upper cap portion can be rotated by the user to adjust the size of the holes 166 and thereby control the ratio of air to liquid being discharged.

An inner cylindrical wall 189 is attached to the member 180 and surrounds the wall 174 except for an opening 188 which aligns with the opening 178. A tubular member 190 extends laterally from the wall 189 and mounts a screen 192. The screen 192 is in the direct path of the spray from the opening 178. When the spray hits the screen, due to surface tension of the liquid, the droplets cover the openings in the screen and air is forced through the screen openings causing bubbles to form, resulting in a foam. Due to the large amount of air available and the small size of the droplets, the discharge is virtually 100% foam, rather than a mixture of liquid and foam as in prior art devices.

An indentation 194 extends around the inside of the wall 188. An outer cylindrical wall 196 is concentric with wall 188 and positions a movable top 198. Top 198 has an inner cylindrical wall 200 which fits within wall 188 and has an enlarged end 202. Top 198 can be pulled upwardly until the enlarged end 202 is received in the indentation 194 forming a liquid tight, leak proof seal. In this position, the top is out of the way of the outlet of tube 190. With the top pushed down, the outlet of tube 190 is covered and the discharge device 100 is in the storage position. In the storage position, a bead 203 on the edge of wall 174 forms a liquid tight, leak proof seal against wall 200.

In operation, the top 198 is pulled up by the user to expose the outlet of the tube 190 and the container 110 is squeezed to force out air and liquid. The liquid travels through the eductor tube 114 into the liquid flow channel which extends to the interior of the valve unit 104. The force of the liquid forces the valve unit up off of the valve seat 124 to completely open the liquid flow channel.

The air is forced out through the openings 162, through the space between body 164 and body 128, and is directed through the channels formed by ribs 138 and over the openings 132 by the curvature of the wall 174. The air flowing over the openings 132 causes a venturi effect to help draw out the liquid and break it up as it mixes with the air. The mixed liquid and air, now in a spray form, travel through the channels formed by the ribs 138 and out of the discharge orifice 178 and contact the screen 192 where they are converted into a foam.

When the container is released, a suction is formed drawing air in through the tube 190, orifice 178 and screen 192. The air cleans the screen 192 and draws any residual liquid into the container through the openings 162. Also, initially, some air is drawn in through the valve unit openings 132 cleaning these openings also. However, the primary effect of the suction on the valve unit 104 is to draw the valve unit onto the valve seat 124 closing off the liquid flow channel. This action prevents air from entering the eductor so that the liquid is positioned adjacent the openings 132 ready for the next operation of the discharge device.

During the discharge operation, the density of the foam can be adjusted by rotating the upper cap portion 106 to change the ratio of air to liquid by controlling the size of the air openings 162, as discussed above.

It will be understood that while the above discussion relates to the use of the discharge device as a foamer, the same operation can be effected without the screen 192 to produce an adjustable spray discharge.

It is also possible to construct the device 100 with ribs attached to and depending from the top wall 174 to space the valve unit 104 from the wall 174. In this case, all of the air flows will not be directed over openings 132 so that the efficiency of the device will be lowered. Further, all the ribs may be eliminated entirely if some other mechanism is used to space valve unit 104 from the wall 174.

The discharge device 100 can be used for either a foamer application or a sprayer application since the openings 132 are not in alignment with the discharge orifice 178 and the air flow channel directs air to the side of the openings away from the discharge orifice. That is, the discharge orifice 178 is spaced laterally of the openings and the air flow channel leads to the side of the openings away from the discharge orifice. In this manner, the air from the container is forced to flow over the tops of the openings 132 to create the venturi effect discussed above. The discharge device operates with the venturi effect at the same time the fluid under pressure moves through the openings 132. The air breaks the liquid particles into a fine mist which is necessary for a high quality spray. In fact, the device 100 can operate only using the pressure, without the venturi effect, although the efficiency of operation will be lessened.

Figure 12:
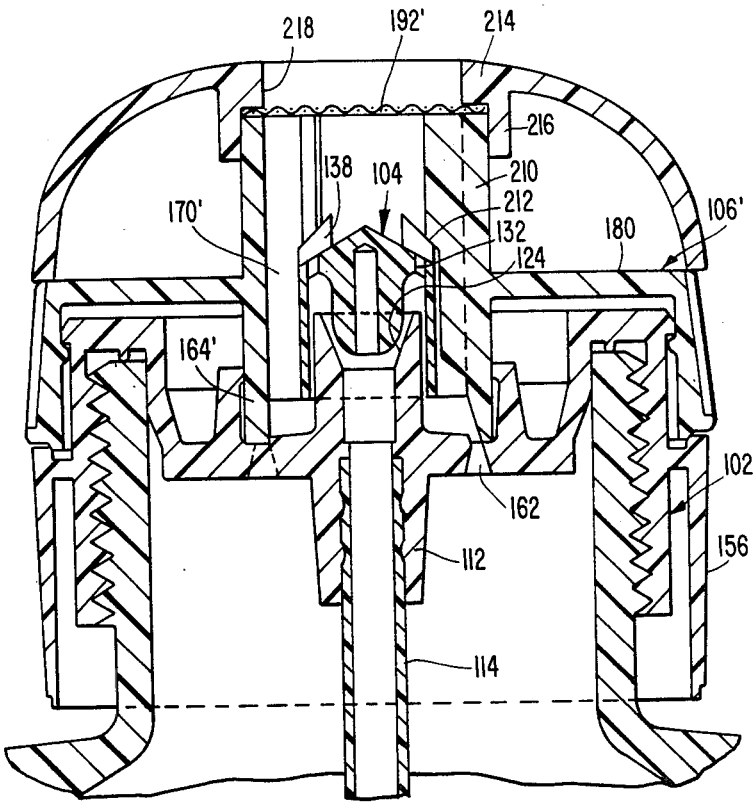
FIG. 12 is an axial sectional view in elevation showing another embodiment of the present invention.
Figure 13:
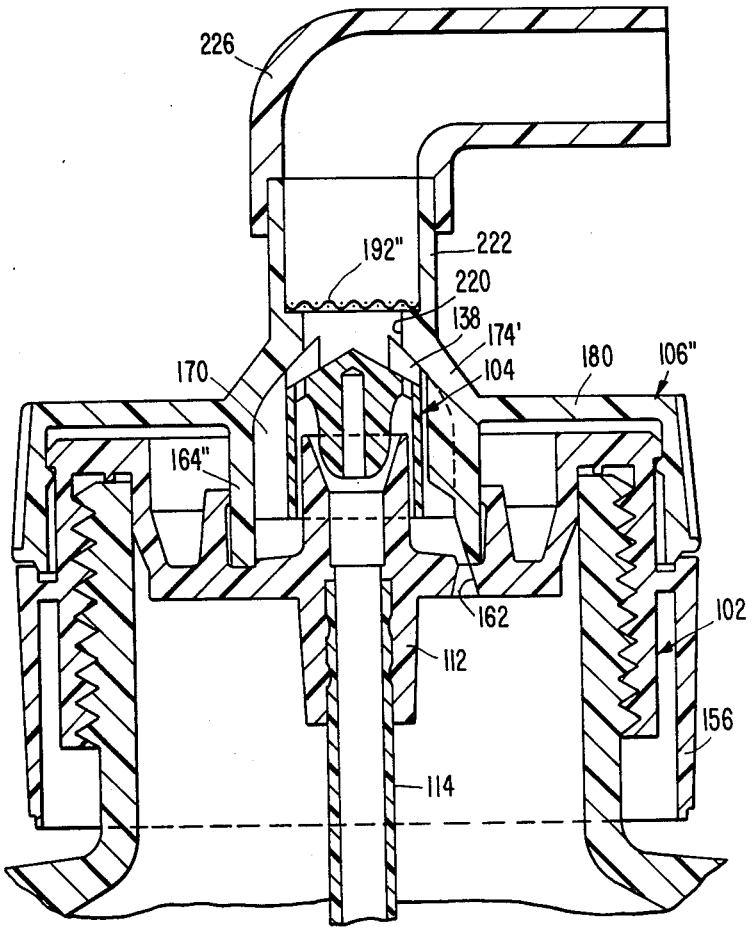
FIG. 13 is an axial sectional in elevation showing a still further embodiment of the present invention.

The venturi effect is also useful in the foaming action. However, the venturi effect does not contribute to the foaming action to the same extent as it does to the spray action. Accordingly, it is not as necessary to ensure the existence of the venturi effect with the same efficiency if the device is to be used only as a foamer. FIGS. 12 and 13 show two embodiments of the discharge device which are designed as foamers only. In FIGS. 12 and 13, parts similar to those in FIG. 9 are given the same reference numerals and will not be discussed again in detail.

In FIG. 12, it can be seen that the lower cap portion 102 and the valve unit 104 are exactly the same as in the embodiment of FIG. 9. Only the upper cap portion 106' is different. The difference in FIG. 12 is that the upper cap portion 106' has a body portion 164' which extends upwardly above the position of the valve unit 104 to form a cylindrical outlet tube 210. Outlet tube 210 mounts a screen 192' which produces foam when hit with liquid and air. In this embodiment, the screen 192' extends across the full width of the valve unit 104. The ribs 170' are formed alongside the valve unit to provide lateral support for the valve unit, as in the embodiment of FIG. 9. It can be seen that the support surfaces 212 on the ribs 117 keep the valve unit from moving too far away from the valve seat 124 when 10 the liquid is under pressure.

The embodiment of FIG. 12 has a cover 214 which is dome shaped. The cover 244 is designed for use with a foaming deodorant, antiperspirant or other products. The cover 214 mounts on the outlet tube 210 by way of cylindrical mounting flange 216 which slides over the end of the outlet tube 210. The cover 214 extends partially over the screen 192' to hold the screen 192' in place on the outlet tube 210. A central opening 218 in the cover 214 forms the outlet for the foam.

FIG. 13 shows an embodiment of the discharge device which is designed to dispense foaming soap, for instance. In this embodiment, the structure of the lower cap portion and the valve unit are the same as in the embodiment of FIG. 9. Only the configuration of the upper cap portion 106" is different so only this portion will be described in detail.

The main difference in the upper cap portion 106" is that the discharge is axial to the valve unit. The body 164 of the upper cap portion leads to a wall 174' which is similar to wall 174 of the embodiment of FIG. 9 except that the wall continues around the entire circumference of the valve unit at the same height and defines a central opening 220. The wall extends partially over the valve unit ribs 138 but does not completely cover the ribs as in the case of the embodiment of FIG. 9. An outlet tube 222 extends axially outward from opening 220 and mounts a screen 192". An additional discharge tube 226 extends from the tube 222 and provides a horizontal discharge of the foam. The larger the openings 218 and 220, the less force which is required on the squeeze container to produce foam. Also, there is less restriction when the container is released so that air is drawn in more quickly and the device is quickly prepared for the next squeeze action.

It will be noted that in the embodiment of FIG. 12, the screen 192' is mounted relatively far from the valve unit while in the embodiment of FIG. 13, the screen 192" is relatively close to the valve unit. It has been found that with the construction of the present invention, the distance of the screen to the valve unit is not a critical factor. The screen can be located in any position after the air and liquid have been mixed. This is an advantage of the invention since there are no design constraints placed on the device because of the need to place the screen at a certain distance from the location at which the air and liquid are mixed.

Also, the screen size is not critical to the proper operation of the invention. Because of the high volume of air moved through the screen and because of the high level of mixture of air and liquid, the screen size is not critical. Of course, with a smaller screen size, the foam will be finer and the surface tension required to produce foam will be decreased.

In every embodiment of the invention, the size of the openings in the valve unit is less than the size of the outlet orifice. This is important since it means that the relatively large outlet orifice will not become easily clogged. The holes in the valve unit also will not become clogged since, initially during the release of the container, air will be drawn back into the container through these openings ensuring that they are clear of liquid. Also, the small size of the openings in the valve unit helps to break the liquid up into fine particles. In this manner, a large flow volume can be achieved with the liquid being broken into sufficiently fine particles to ensure a good spray or foaming action.

As discussed above, in the embodiments designed for use as a sprayer, the air stream is directed over the openings in the valve unit to ensure an even greater breaking up of the liquid into a fine mist. In these units, the screen can be provided as an add on attachment so that the device can be selectively used as a sprayer or a foamer.

The entire discharge device of the present invention can be easily produced using conventional injection molding techniques. Each element of the device can be formed from one set of molds. Further, since the placement of the screen for the foamer is not critical, foamers can be produced from the same molds as the sprayers with the screen being added as a separate part at any convenient location.

It will clearly be understood that the invention is not limited in any respect to the particular features specified in the foregoing or to the details of the particular embodiments which have been chosen in order to illustrate the invention. Without thereby departing either from the scope or the spirit of this invention, it remains possible to consider all kinds of variants and to make any number of modifications in the particular forms of construction hereinabove described by way of example and in their constituent elements. Thus the invention includes all technical equivalents of the means hereinabove described as well as combinations of such means.

What is claimed is:

1. A device for mixing air and liquid, comprising:

attachment means for connection to a flexible container which contains a liquid and air;

a member having a plurality of liquid flow holes;

an eductor tube;

liquid flow path means connected to said attachment means and said educor tube for defining a liquid flow path from said eductor tube to said member having said plurality of liquid flow holes;

a valve positioned in said liquid flow path and being movable between a blocking position and a discharge position, said valve being operative in said blocking position to block said liquid flow path and being operative in said discharge position to unblock said liquid flow path, said valve being responsive to liquid pressure in said liquid flow path to be moved to said discharge position to permit liquid under pressure to pass through said plurality of liquid flow holes and be broken up into a plurality of fine liquid streams;

air flow path means for defining an air flow path from a position within said container to a position adjacent said liquid flow holes for supplying air to break up said plurality of fine liquid streams passing through said liquid flow holes such that said air and said liquid are mixed after said liquid passes through said liquid flow holes;

a cap member having a discharge orifice, said discharge orifice being larger than any of said plurality of liquid flow holes; and mixture path means defining a mixture flow path from said position adjacent said liquid flow holes to said discharge orifice to guide a mixture of air and liquid to said discharge orifice.

2. The device as claimed in claim 1 including means for forming a foam, said foam forming means being positioned to receive said mixture of liquid and air from said discharge orifice.

3. The device as claimed in claim 2, wherein said foam forming means comprises a screen.

4. The device as claimed in claim 3, wherein said valve and said member having a plurality of liquid flow holes are connected for movement together.

5. The device as claimed in claim 4, wherein said valve and said member having a plurality of liquid flow holes form a valve unit having a cylindrical body, a top containing said liquid flow holes, and said valve depending from said top, said liquid flow path extending inside of said body.

6. The device as claimed in claim 1, wherein said orifice is spaced laterally of said liquid flow holes and said air flow path supplies air to a side of said liquid flow holes which is away from said orifice so that air from said air flow path must flow over said liquid flow holes to reach said orifice.

7. The device as claimed in claim 6 including a screen disposed across said orifice.

8. The device as claimed in claim 7, wherein said screen extends across all of said liquid flow holes.

9. The device as claimed in claim 1, including a screen disposed over said liquid flow holes.

10. The device as claimed in claim 1, wherein said air flow path is parallel to said liquid flow path through said liquid flow holes.

11. The device as claimed in claim 10, including a screen disposed over said liquid flow holes and said air flow path.

12. A device for mixing air and liquid, comprising:

attachment means for connection to a flexible container which contains a liquid and air;

a member having a plurality of liquid flow openings;

an eductor tube;

liquid flow path means connected to said attachment means and said eductor tube for defining a liquid flow path from said eductor tube to said member having said plurality of openings;

a valve positioned in said liquid flow path and being movable between a blocking position and a discharge position, said valve being operative in said blocking position to block said liquid flow path and being operative in said discharge position to unblock said liquid flow path, said valve being responsive to liquid pressure in said liquid flow path to be moved to said discharge position to permit liquid under pressure to pass through said plurality of openings and be broken up into a plurality of fine liquid streams;

air flow path means for defining an air flow path from said position within said container to a position adjacent said openings for supplying air to break up said plurality of fine liquid streams;

a cap member having a discharge orifice, said discharge orifice being larger thany any of said plurality of openings;

a mixture path means defining a mixture flow path from said position adjacent said openings to said discharge orifice to guide a mixture of air and liquid to said discharge orifice, and means for adjusting the relative flow rate of said liquid flow path and said air flow path.

13. The device as claimed in claim 12, wherein said adjusting means comprises means for constricting said air flow path.

14. The device as claimed in claim 13, wherein said air flow path includes a plurality of air flow holes and said means for constricting said air flow path comprises means for at least partially covering said air flow holes.

15. The device as claimed in claim 14, wherein said device comprises an upper cap portion and a lower cap portion, and said upper cap portion is rotatably mounted to said lower cap portion, said means for at least partially covering said air flow holes being mounted for rotation with said upper cap portion, and said air flow holes being formed in said lower cap portion.

16. The device as claimed in claim 12, wherein said adjusting means can reverse the ratio of flow rates so that the device can be operated upside down.

17. A combination, comprising:

a flexible container containing a liquid and air;

attachment means for connection to said flexible container;

a member having a plurality of liquid flow holes;

an eductor tube;

liquid flow path means connected to said attachment means and said eductor tube for defining a liquid flow path from said eductor tube to said member having said plurality of liquid flow holes;

a valve positioned in said liquid flow path and being movable between a blocking position and a discharge position, said valve being operative in said blocking position to block said liquid flow path and being operative in said discharge position to unblock said liquid flow path, said valve being responsive to liquid pressure in said liquid flow path to be moved to said discharge position to permit liquid under pressure to pass through said plurality of liquid flow holes and be broken up into a plurality of fine liquid streams;

air flow path means for defining an air flow path from a position within said container to a position adjacent said liquid flow holes for supplying air to break said plurality of fine liquid streams passing through said liquid flow holes such that said air and said liquid are mixed after said liquid passes through said liquid flow holes;

a cap member having a discharge orifice, said discharge orifice being larger than any of said plurality of liquid flow holes; and mixture path means defining a mixture flow path from said position adjacent said liquid flow holes to said discharge orifice to guide a mixture of air and liquid to said discharge orifice.

18. A combination as set forth in claim 17 including means for forming a foam, said foam forming means comprising a screen positioned across said orifice.

* * * * *